US008176666B2

(12) United States Patent
Martin et al.

(10) Patent No.: US 8,176,666 B2
(45) Date of Patent: May 15, 2012

(54) SIGN HOLDER

(75) Inventors: Erica A. Martin, Otsego, MN (US); Tracy M. Tonnessen, Minneapolis, MN (US)

(73) Assignee: Target Brands, Inc., Minneapolis, MI (US)

( * ) Notice: Subject to any disclaimer, the term of this patent is extended or adjusted under 35 U.S.C. 154(b) by 115 days.

(21) Appl. No.: 12/888,057

(22) Filed: Sep. 22, 2010

(65) Prior Publication Data

US 2012/0066948 A1 Mar. 22, 2012

(51) Int. Cl.
*G09F 3/18* (2006.01)

(52) U.S. Cl. ..... 40/649; 40/308; 40/536; 40/658; 40/661.03

(58) Field of Classification Search ..... 40/649, 40/376, 389, 388, 390, 404, 533, 536
See application file for complete search history.

(56) References Cited

U.S. PATENT DOCUMENTS

| | | | | | |
|---|---|---|---|---|---|
| 1,296,304 | A | * | 3/1919 | Marx | 40/120 |
| 1,483,408 | A | | 2/1924 | Bernstein | |
| 2,091,260 | A | | 8/1937 | Farkas et al. | |
| 2,523,202 | A | * | 9/1950 | Ericson | 281/33 |
| 2,827,718 | A | | 3/1958 | Howard | |
| 2,889,937 | A | | 6/1959 | Best | |
| 3,022,593 | A | | 2/1962 | Sides | |
| 3,296,724 | A | | 1/1967 | Deuchar | |
| 3,398,475 | A | | 8/1968 | Palmer | |
| 3,545,112 | A | | 12/1970 | Pershing et al. | |
| 4,222,187 | A | * | 9/1980 | Huck | 40/649 |
| 4,369,948 | A | * | 1/1983 | Krauss et al. | 248/444.1 |
| 4,531,311 | A | * | 7/1985 | Howard et al. | 40/649 |
| 4,666,409 | A | * | 5/1987 | Sandberg | 434/365 |
| D291,097 | S | | 7/1987 | Dalbey et al. | |
| 4,760,660 | A | | 8/1988 | Fast | |
| 4,761,904 | A | | 8/1988 | Fast et al. | |
| 4,798,014 | A | * | 1/1989 | Stoerzinger et al. | 40/642.02 |
| 4,982,683 | A | * | 1/1991 | Earnest, Jr. | 116/63 P |
| 4,995,182 | A | * | 2/1991 | Fast | 40/649 |
| 5,263,269 | A | * | 11/1993 | Tjarnlund | 40/5 |
| 6,263,603 | B1 | * | 7/2001 | Wildrick | 40/661 |
| 6,493,969 | B2 | | 12/2002 | Devos | |
| D527,426 | S | | 8/2006 | Mason | |
| 7,155,853 | B2 | * | 1/2007 | Valiulis | 40/661 |
| 7,219,459 | B2 | | 5/2007 | Valiulis et al. | |
| 7,340,855 | B2 | | 3/2008 | Wiltfang et al. | |
| 7,367,149 | B2 | | 5/2008 | Fast et al. | |
| 7,386,950 | B2 | | 6/2008 | Fast et al. | |
| 2007/0245611 | A1 | | 10/2007 | McDonald | |

* cited by examiner

*Primary Examiner* — Joanne Silbermann
*Assistant Examiner* — Shin Kim
(74) *Attorney, Agent, or Firm* — Leanne Taveggia Farrell; Westman, Champlin & Kelly, P.A.

(57) ABSTRACT

A sign holder includes a sleeve, a support and a plurality of rings. The sleeve has a front portion having a first height and a back portion having a second height that is greater than the first height of the front portion. The back portion is connected to the front portion by a bottom connecting portion and includes a plurality of spaced apart apertures that extend through a thickness of the back portion and are located along the back portion at least partially above the corresponding first height of the front portion. The support includes a support member and a connecting member connected to the support member. The connecting member is substantially perpendicular to the support member and is attached to a backward facing surface of the back portion. The plurality of rings are each threaded through one of the apertures in the back portion.

20 Claims, 6 Drawing Sheets

SIGN HOLDER

BACKGROUND

Retail establishments commonly use various types of display structures to present products to customers for purchase. These display structures both support the product for display and indicate the product price. An example display structure includes a shelf-type structure having a plurality of levels of shelves including a lower shelf called a base deck.

In general, shelf-type display structures display products by resting or stacking them on the shelves. Each shelf has a channel that holds a price label support that supports a price label along the front of the shelf. The price label provides pricing and product information for the products.

Often, retailers desire to highlight certain products that are being displayed for sale. For example, a retailer may want to bring certain products to the attention of the customer because they were advertised in a certain media format, such as a catalog, a mailer or a commercial. In another example, a retailer may want to highlight certain products that have certain characteristics not possessed by similarly displayed products, such as products that are on sale or products that have promotional incentives.

Often, retailers highlight these select products by enhancing the visual appearance of the display structure by adding additional visual elements near the price label so as to draw attention to the product. Highlighting products that are positioned on the base deck or lowermost shelf of a shelf-type display structure can be difficult. At this low level, visual elements can be easily knocked off and can be oriented improperly for viewing.

The discussion above is merely provided for general background information and is not intended to be used as an aid in determining the scope of the claimed subject matter.

SUMMARY

A sign holder includes a sleeve, a support and a plurality of rings. The sleeve and the support are made of transparent plastic. The sleeve has a front portion having a first height and a back portion having a second height that is greater than the first height of the front portion. The back portion is connected to the front portion by a bottom connecting portion and includes a plurality of spaced apart apertures that extend through a thickness of the back portion and are located along the back portion below the second height of the back portion and at least partially above a position that corresponds with the first height of the front portion. The support has a horizontal member and a vertical member connected to the horizontal member. The vertical member is substantially perpendicular to the horizontal member and is adhesively attached to a backward facing surface of the back portion. The plurality of rings are each threaded through one of the apertures in the back portion.

The sign holder is attached to fencing on a product display structure using the plurality of rings. A printed sign is inserted between the front portion and the back portion of the sleeve. The printed sign includes a height that is less than the first height of the front portion.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein include a sign holder for retaining a sign to highlight various products being supported on a base deck or lowermost shelf of a shelf-type display structure. The sign holder includes first, second and third components assembled together. The first component comprises a transparent plastic sleeve, the second component comprises a transparent plastic support and the third components comprise a plurality of metallic rings. The rings are mounted to apertures in the first component and couple to fencing located on a base deck of a shelf-type display structure. The second component is attached to the first component.

Figure 1:
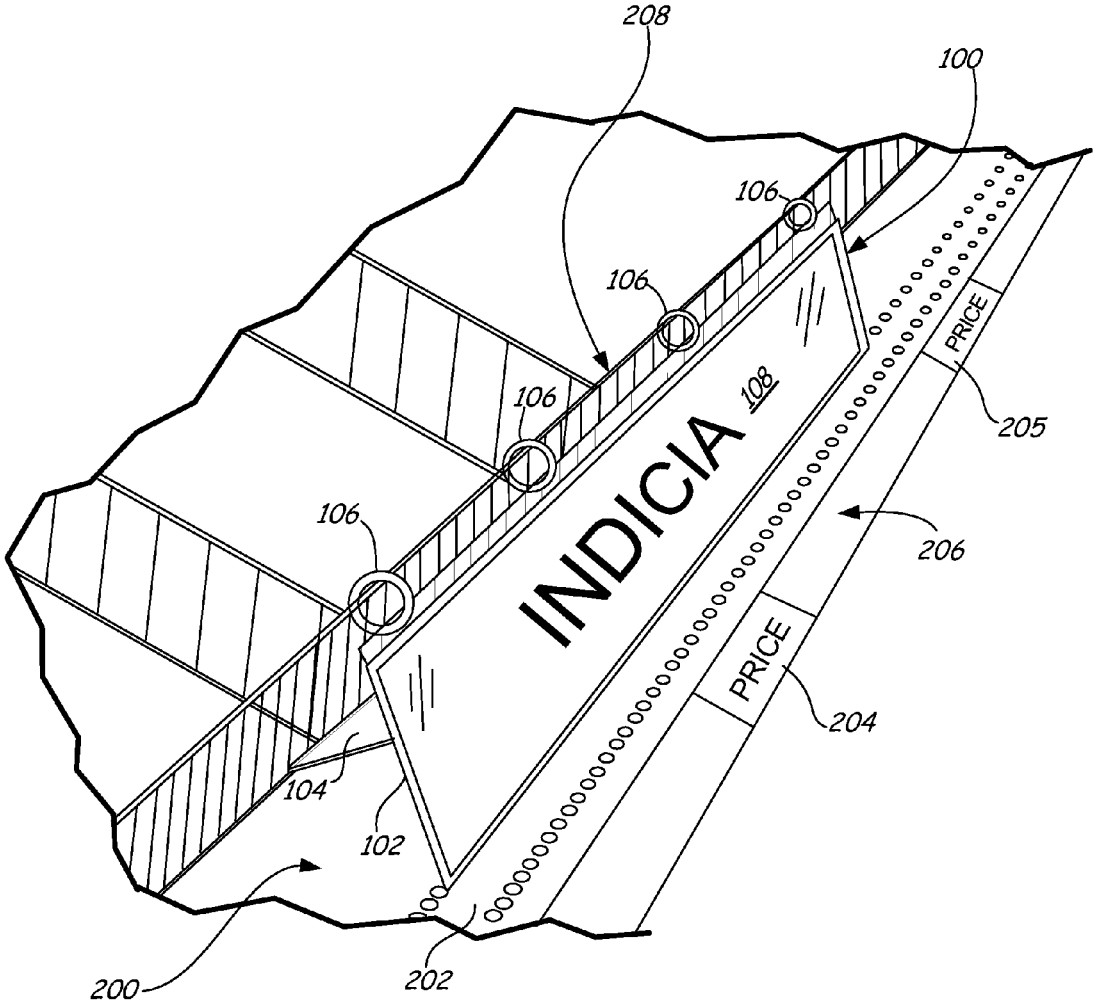
FIG. 1 is a perspective view of a sign holder for a shelf-type display structure under one embodiment.

FIG. 1 illustrates a sign holder 100 for a shelf-type display structure 200 under one embodiment. Shelf-type display structure 200 includes a base deck 202, which is the lowermost shelf of shelf-type display structure 200. Base deck 202 includes a channel that holds a price label support that supports price labels 204 and 205 along a front 206 of the base deck. Each price label 204 and 205 provides pricing and product information for the products stacked on the base deck or shelf behind it.

In some areas of a store, a base deck 200 includes a fencing structure 208 or other type of structure located behind the front 206 of the base deck to better retain products on the shelf for display. For example, fencing or other structure can be used to separate stationary type products such as stacks of notebooks and paper. In another example, fencing can be used to separate bins of child party favors. As illustrated in FIG. 1, sign holder 100 is mounted to fencing structure 208. The indicia or information printed on the sign highlight products associated with the corresponding price label 204 or products on display.

Sign holder 100 (FIG. 1) includes a first component 102, a second component 104 and a plurality of third components 106. First component 102 comprises a transparent plastic sleeve for retaining a sign 108 having printed indicia or information. Second component 104 comprises a support for orienting the transparent sleeve 102 at an angle. The plurality of third components 106 comprises a plurality of rings for securing sign holder 100 to fencing structure 208.

Figure 2:
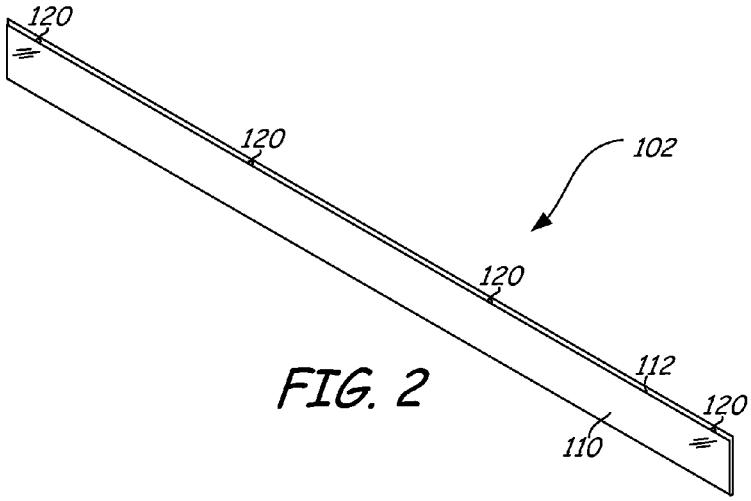
FIG. 2 is a front perspective view of a first component of the sign holder illustrated in FIG. 1.
Figure 3:
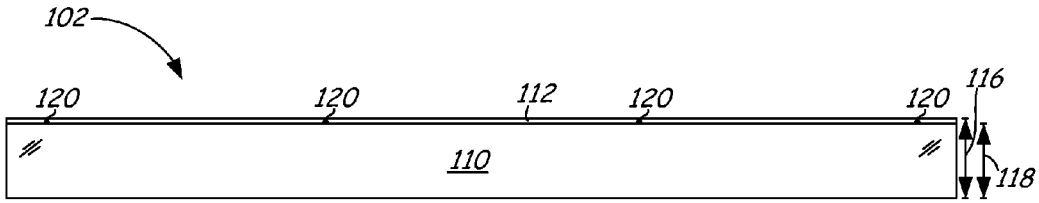
FIG. 3 is a front view of the first component of the sign holder illustrated in FIG. 1.
Figure 4:
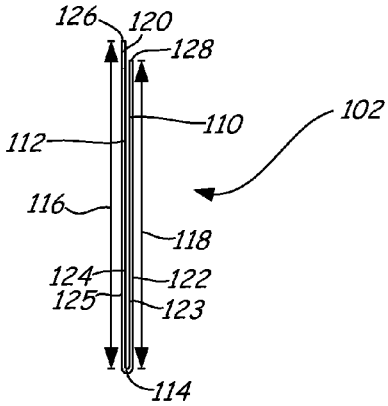
FIG. 4 is side view of the first component of the sign holder illustrated in FIG. 1.

FIG. 2 illustrates a front perspective view, FIG. 3 illustrates a front view and FIG. 4 illustrates a side view of first component or sleeve 102 of the sign holder 100 illustrated in FIG. 1. Sleeve 102 can be made of a clear or transparent thermoplastic of the polyester family, such as Polyethylene Terephthalate Glycol (PETG), and includes an integrally formed front portion or front piece 110, back portion or back piece 112 and bottom connecting portion or bottom connecting piece 114.

Front portion 110 has a forward facing surface 122 and a backward facing surface 123 that faces the back portion 112. Back portion 112 has a forward facing surface 124 that faces front portion 110 and a backward facing surface 125. A first height 118 of front portion 110 extends from connecting portion 114 to a front top edge 128. A second height 116 of back portion 112 extends from connecting portion 114 to a back top edge 126. Second height 116 of back portion 112 is greater than first height 118 of front portion 110.

Back portion 112 includes a plurality of spaced apart apertures 120 that extend through the thickness of back portion 112 from forward facing surface 124 to backward facing surface 125. Apertures 120 are at least partially located in a position on back portion 112 corresponding to an area between the back top edge 126 of back portion 112 and the front top edge 128 of front portion 110. In other words, apertures 120 are located along back portion 112 below the second height 116 of back portion 112 and at least partially above a position that corresponds with the first height 118 of front portion 110. Backward facing surface 123 of front portion 110, forward facing surface 124 of back portion 112 and bottom connecting portion 114 are configured to accommodate a printed sign having indicia.

Figure 5:
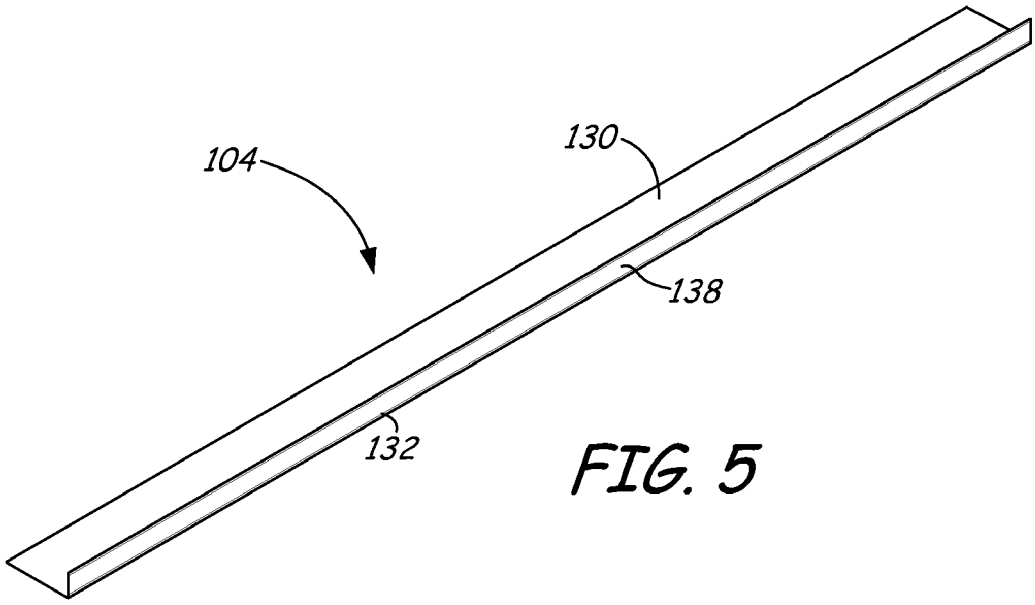
FIG. 5 is a front perspective view of a second component of the sign holder illustrated in FIG. 1.
Figure 6:
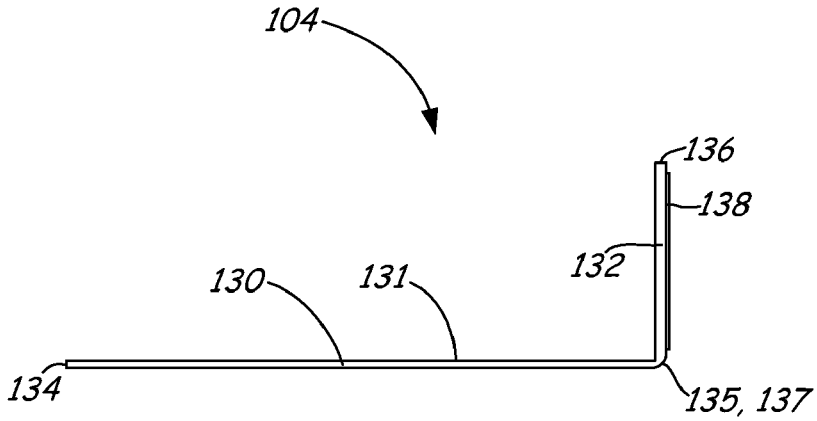
FIG. 6 is a side view of the second component of the sign holder illustrated in FIG. 1.

FIG. 5 illustrates a front perspective view and FIG. 6 illustrates a side view of second component or support 104 of the sign holder 100 illustrated in FIG. 1. Like sleeve 102, support 104 can also be made of a clear or transparent thermoplastic of the polyester family, such as PETG, and includes an integrally formed support member 130 and connecting member 132. Support member 130 includes a back edge 134 and a front end 135. Connecting member 132 includes a top edge 136 and a bottom end 137. The bottom end 137 of support member 132 is connected to the front end 135 of support member 130 such that connecting member 132 is substantially perpendicular to support member 130 (i.e., connecting member 132 is in a plane substantially vertical to the substantially horizontal plane of support member 130).

Therefore, support member 130 is also substantially perpendicular to front portion or front piece 110 and back portion or back piece 112 of first component or sleeve 102. In one embodiment, connecting member 132 is adhesively coupled to first component or sleeve 102 by an adhesive 138 such that first component or sleeve 102 is attached to second component or support 104. Adhesive 138 can be of various types, such as, for example, a clear adhesive tape. It should be realized, however, other ways of coupling support 104 to sleeve 102 are possible.

Figure 7:
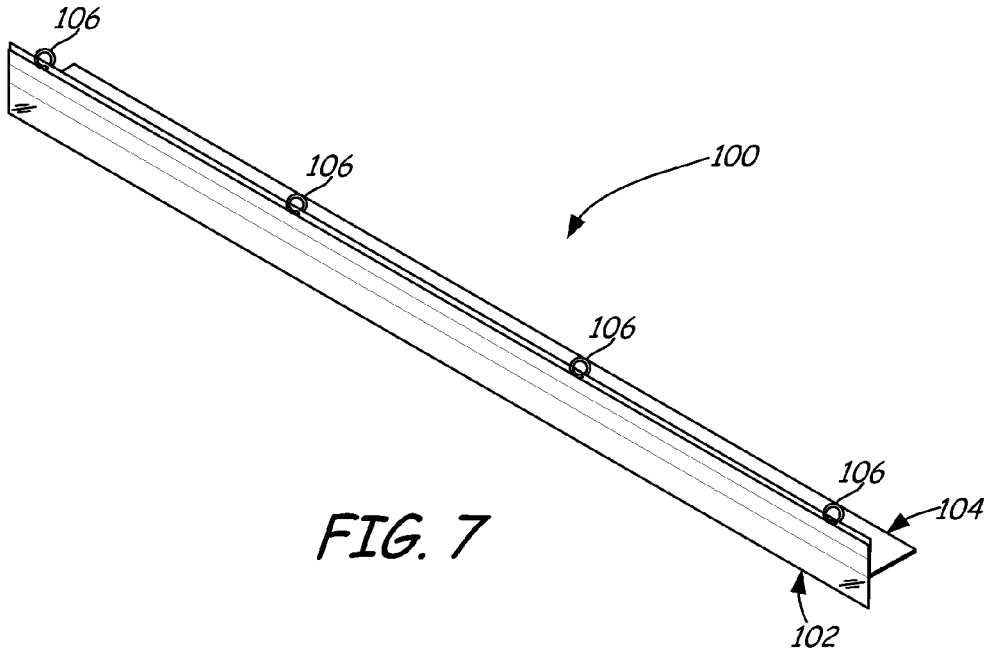
FIG. 7 is a front perspective view of the assembled first, second and third components of the sign holder illustrated in FIG. 1.
Figure 8:
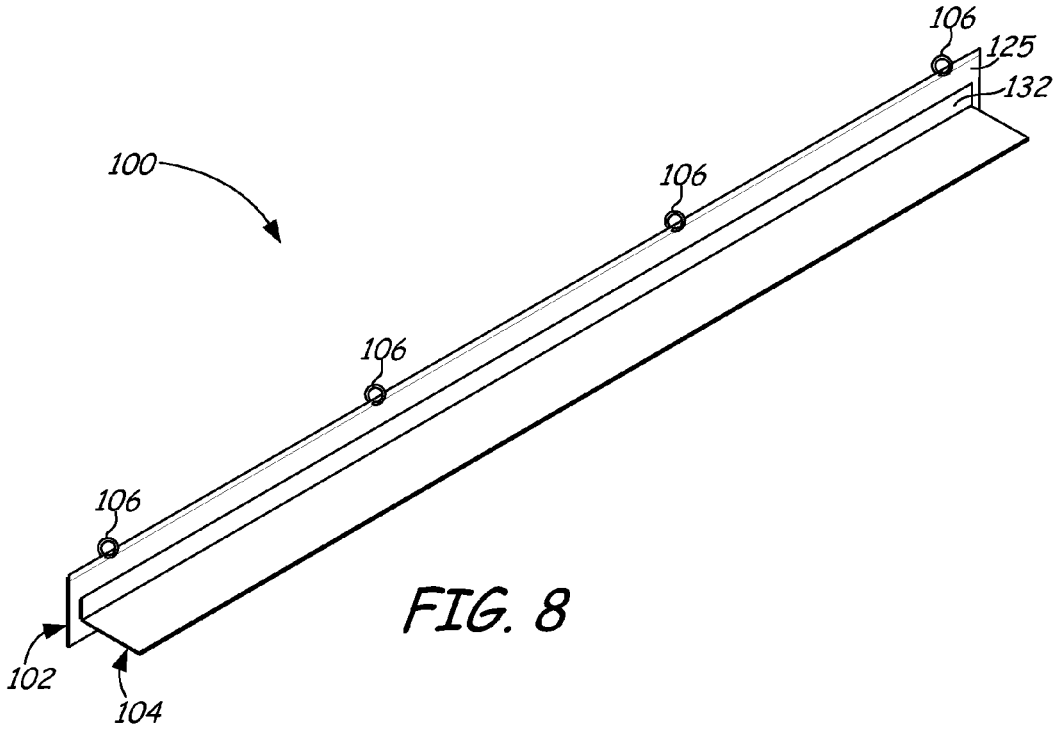
FIG. 8 is a back perspective view of the assembled first, second and third components of the sign holder illustrated in FIG. 1.
Figure 9:
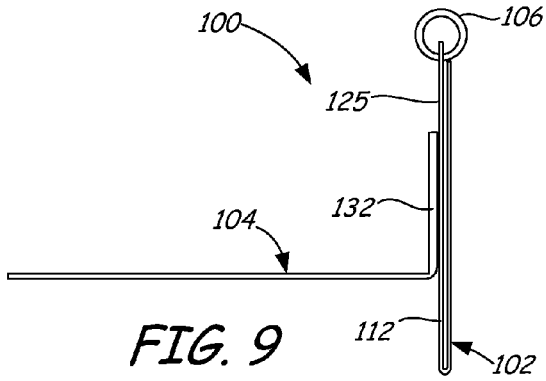
FIG. 9 is a side view of the assembled first, second and third components of the sign holder illustrated in FIG. 1.
Figure 10:
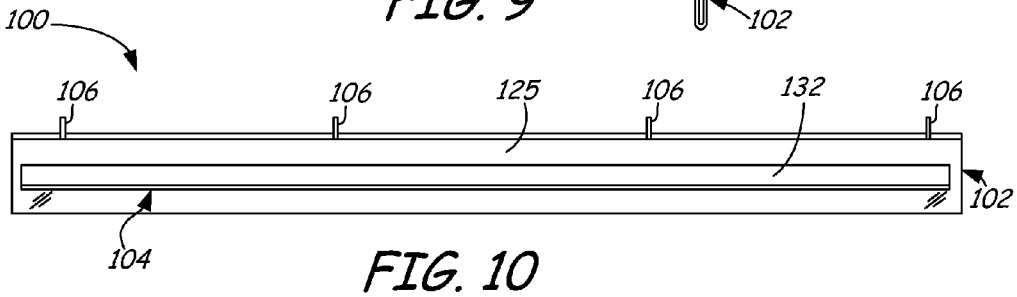
FIG. 10 is a back view of the assembled first, second and third components of the sign holder illustrated in FIG. 1.
Figure 11:
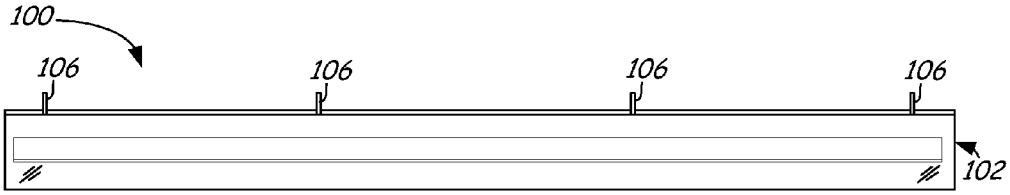
FIG. 11 is a front view of the assembled first, second and third components of the sign holder illustrated in FIG. 1.
Figure 12:
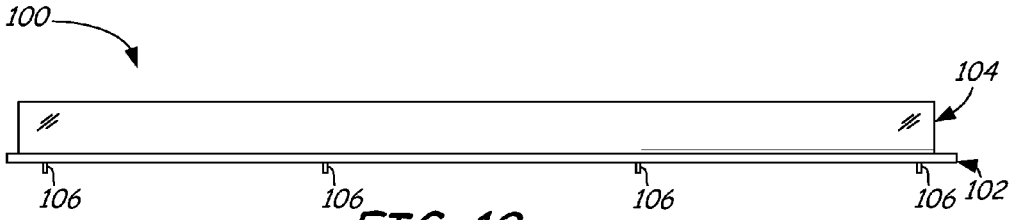
FIG. 12 is a bottom view of the assembled first, second and third components of the sign holder illustrated in FIG. 1.
Figure 13:
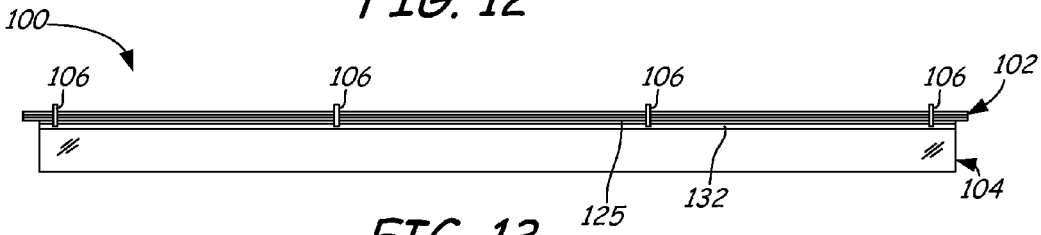
FIG. 13 is a top view of the assembled first, second and third components of the sign holder illustrated in FIG. 1.

FIG. 7 is a front perspective view, FIG. 8 is a back perspective view, FIG. 9 is a side view, FIG. 10 is a back view, FIG. 11 is a front view, FIG. 12 is a bottom view and FIG. 13 is a top view of the assembled first component or sleeve 102, second component or support 104 and third components or rings 106 of the sign holder 100 illustrated in FIG. 1. As illustrated in FIGS. 7-13, the connecting member 132 of support 104 is coupled to backwards facing surface 125 of the back portion 112 of transparent sleeve 102. In general, the support 104 is centered on the back portion 112. As also illustrated in FIGS. 7-13, each third component or ring 106 is threaded through each aperture 120 (FIGS. 2-3) positioned in back portion 112 of sleeve 102 and locked together.

With reference back to FIG. 1, rings 106 can be metallic rings that can attach and detach from fencing 208 by opening the encircled rings to hook onto the fencing and closing the circled rings around the fencing. Each ring 106 is closed around a portion of fencing structure 208 to secure sign holder 100 to shelf-type display structure 200. Once the rings 106 are attached to fencing structure 208, sign holder 100 is allowed to hang downwards due to gravity.

Because of the position of support 104, support member 130 comes into contact with the fencing structure or other type structure and tilts sleeve 102 upwards at an angle so as to orient the forward facing surface 122 of front portion 110 to display printed material to a customer or guest who is looking down at the base deck 202 of the shelf-type display structure 200 from a standing position.

In particular, back edge 134 of support member 130 intersects with the fencing structure or other type structure such that an upward facing surface 131 of support member 130 forms an angle with the fencing structure or other type of structure that is less than 90 degrees. Likewise, the forward facing surface 122 of front portion 110 forms an angle with a guest who is looking down at the base 202 from standing that less than 90 degrees.

In the alternative, back edge 134 of support member 130 can contact other components of a display shelf system to form an angle with the component that is less than 90 degrees. The combination of the tilting of front portion 110 as provided by support member 130, the metallic rings 106 for coupling to a fencing or other type of structure and sleeve 102 of sign holder 100 not only allows a guest to take notice of the sign, but also is constructed to avoid being inadvertently knocked off the bottom of the shelf by, for example, a guest's foot or a cart or stroller.

A method of altering a product display structure 200 in a retail store is provided. The method includes obtaining sign holder 100. While the construction of and structure of sign holder 100 is described in detail above, sign holder includes at least a transparent plastic sleeve 102, a transparent plastic support 104 and a plurality of rings 106. The sign holder is attached to fencing structure 208 or other type of structure on the product display structure 200 using the plurality of rings 106.

Figure 14:
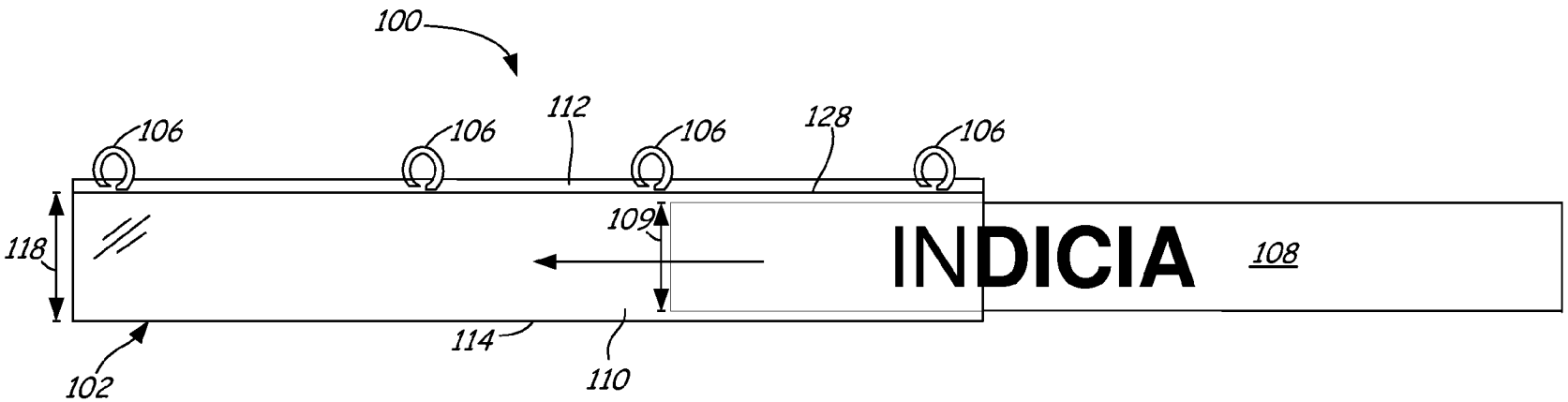
FIG. 14 is a front view illustrating the insertion of a printed sign into the sign holder illustrated in FIG. 1.

After sign holder 100 is attached to fencing structure 208 as illustrated in FIG. 1, an appropriate sign 108 having printed indicia or information is inserted into sign holder 100. FIG. 14 is a front view illustrating the insertion of printed sign 108 into the transparent sleeve 102 of sign holder 100. As illustrated, printed sign 108 is inserted between front portion 110 and back portion 112, and is located above bottom connecting portion 114 and along the sleeve 102 below the back top edge 128 of front portion 110. It should be realized that printed sign 108 can also be inserted before sign holder 100 is attached to fencing or other type of structure 208. The indicia on printed sign 108 highlights the products that are being displayed for sale. For example, indicia can advertise or promote the product on display to explain certain characteristics not possessed by similarly displayed products.

Printed sign 108 includes a height 109. As illustrated in FIG. 14, the height 109 of printed sign 108 is less than the first height 118 of the front portion 110. Such a height 109 allows rings 106 to be suitably threaded through apertures without the obstruction of printed sign 108.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A sign holder comprising:

a first component having a front portion including a front top edge and a back portion having a back top edge, the back portion being connected to the front portion by a bottom connecting portion and including a plurality of spaced apart apertures that extend through a thickness of the back portion and are located along the back portion below the back top edge of the back portion and at least partially above a position that corresponds with the front top edge of the front portion;

a second component coupled to a backward facing surface of the back portion and including at least one member that is substantially perpendicular to the front and back portions of the first component;

a plurality of third components comprising rings, each ring threaded through one of the apertures in the back portion and attachable to a display structure that displays products; and a printed sign located between the front portion and the back portion of the first component and including a height that is less than the first height of the front portion.

2. The sign holder of claim 1, wherein the first component and the second component comprise transparent plastic.

3. The sign holder of claim 1, wherein the rings comprise metallic rings.

4. The sign holder of claim 1, wherein the front portion includes a first height extending from the bottom connecting portion to the front top edge and the back portion includes a second height extending from the bottom connecting portion to the back top edge, the second height of the back portion being greater than the first height of the front portion.

5. The sign holder of claim 4, wherein the plurality of spaced apart apertures are located along the back portion below the second height of the back portion and at least partially above a position that corresponds with the first height of the front portion.

6. The sign holder of claim 1, wherein the at least one member of the second component comprises a support member and a connecting member, the support member being integrally connected to the connecting member and substantially perpendicular to the connecting member.

7. The sign holder of claim 6, wherein the connecting member is adhesively coupled to the backward facing surface of the back portion.

8. The sign holder of claim 6, wherein the plurality of rings are attachable to fencing of the display structure.

9. The sign holder of claim 8, wherein when the plurality of rings are attached to the fencing, a back edge of the support member intersects with the fencing to cause the front portion of the first component to tilt upwards.

10. A display structure comprising:

a base deck including a fencing structure located behind a front of the base deck and constructed to retain products on display;

a sign holder comprising:

a transparent sleeve having a front piece including a first height and a back piece including a second height that is greater than the first height of the front portion, the back piece being connected to the front piece by a bottom connecting piece and including a plurality of spaced apart apertures that extend through a thickness of the back piece and are located along the back piece below the second height of the back piece and at least partially above a position that corresponds with the first height of the front piece;

a transparent support having a support member and a connecting member connected to the support member, the connecting member being substantially perpendicular to the support member and being coupled to a backward facing surface of the back piece; and a plurality of rings, each ring being threaded through one of the apertures in the back portion and being attachable to the fencing structure; and a printed sign located between the front piece and the back piece of the transparent sleeve and including a height that is less than the first height of the front piece, the printed sign including information related to the products on display.

11. The sign holder of claim 10, wherein the plurality of rings comprise metallic rings.

12. The sign holder of claim 10, wherein the transparent sleeve and the transparent support are made of PETG.

13. The sign holder of claim 10, wherein the front piece includes a front top edge and the back piece includes a back top edge.

14. The sign holder of claim 13, wherein the plurality of spaced apart apertures are located along the back piece below the back top edge of the back piece and at least partially above a position that corresponds with the front top edge of the front piece.

15. The sign holder of claim 10, wherein a back edge of the support member intersects with the fencing structure causing an upward facing surface of the support member to form an angle with the fending structure that is less than 90 degrees.

16. A method of altering a product display structure in a retail store, the method comprising:

obtaining a sign holder comprising:

a transparent plastic sleeve including a front portion having a first height and a back portion having a second height that is greater than the first height of the front portion, the back portion being connected to the front portion by a bottom connecting portion and including a plurality of spaced apart apertures that extend through a thickness of the back portion and are located along the back portion below the second height of the back portion and at least partially above a position that corresponds with the first height of the front portion;

a transparent plastic support having a support member and a connecting member connected to the support member, the connecting member being substantially perpendicular to the support member and being attached to a backward facing surface of the back portion;

a plurality of rings, each ring threaded through one of the apertures in the back portion;

attaching the sign holder to fencing on the product display structure using the plurality of rings; and inserting a printed sign between the front portion and the back portion of the sleeve, the printed sign including a height that is less than the first height of the front portion.

17. The method of claim 16, wherein the plurality of rings comprise metallic rings.

18. The method of claim 17, wherein attaching the sign holder to fencing on the product display structure comprises opening each of the plurality of metallic rings to hook onto the fencing.

19. The method of claim 18, further comprising closing each of the plurality of metallic rings after the rings are hooked onto the fencing to secure the sign holder to the product display structure.

20. The method of claim 16, wherein the support member of the transparent plastic support rests on the fencing and thereby tilts the transparent plastic sleeve at an angle to display the printed sign.

* * * * *